US007025241B2

(12) United States Patent
Castellanos

(10) Patent No.: US 7,025,241 B2
(45) Date of Patent: Apr. 11, 2006

(54) GRAVITY TIN TAG FEEDER ATTACHMENT

(76) Inventor: Jorge Luis Castellanos, 10905 SW. 84th Ct., Miami, FL (US) 33156

( * ) Notice: Subject to any disclaimer, the term of this patent is extended or adjusted under 35 U.S.C. 154(b) by 0 days.

(21) Appl. No.: 10/792,534

(22) Filed: Mar. 3, 2004

(65) Prior Publication Data

US 2004/0173658 A1 Sep. 9, 2004

Related U.S. Application Data

(60) Provisional application No. 60/451,461, filed on Mar. 3, 2003.

(51) Int. Cl.
*B25C 7/00* (2006.01)

(52) U.S. Cl. ..... 227/18; 227/107; 227/113; 227/120

(58) Field of Classification Search ..... 277/37, 277/107, 113, 120, 18
See application file for complete search history.

(56) References Cited

U.S. PATENT DOCUMENTS 4,033,499 A * 7/1977 Butler ..... 227/120
4,346,831 A * 8/1982 Haytayan ..... 227/8
4,424,929 A * 1/1984 Weis ..... 227/32
5,056,684 A * 10/1991 Beach et al. ..... 221/197
5,476,204 A * 12/1995 Eisenpresser et al. ..... 227/18
5,544,552 A * 8/1996 Kirsch et al. ..... 81/44
6,065,660 A * 5/2000 Cabrera ..... 227/8
6,145,725 A * 11/2000 Omli ..... 227/18
6,273,315 B1 * 8/2001 McGuinness et al. ..... 227/18
6,302,310 B1 * 10/2001 Lamb ..... 227/119
6,543,666 B1 * 4/2003 Huang ..... 227/18
6,779,700 B1 * 8/2004 Bruins et al. ..... 227/136
2001/0054635 A1 * 12/2001 Schmitz ..... 227/15
2003/0015565 A1 * 1/2003 Lee ..... 227/18
2003/0057248 A1 * 3/2003 Bruins et al. ..... 227/18

* cited by examiner

*Primary Examiner*—Scott A. Smith
*Assistant Examiner*—Gloria R. Weeks

(57) ABSTRACT

A device attaches to a roofing nail gun for individually feeding disc-shaped tin tags into centered alignment with the nail gun hammer for safe and accurate center nailing of the tin tag to a host surface. A chute on the device extends from an open top end to a bottom end having a tin tag passage hole centered below the nail gun hammer. Tin Tags are individually deposited through the open top of the device and slide down the chute. Magnets at the bottom end direct and hold the tin tag in centered alignment between the nail gun hammer and passage hole. The bottom portion of the chute is spring biased to allow the nail gun to be pressed downwardly so that the hammer urges the tin tag through the hole and against the host surface prior to firing the nail.

14 Claims, 5 Drawing Sheets

GRAVITY TIN TAG FEEDER ATTACHMENT

BACKGROUND OF THE INVENTION

I hereby claim the benefit under Title 35, United States Code Section 119(e) of U.S. provisional application No. 60/451,461 filed on Mar. 3, 2003.

FIELD OF THE INVENTION

This invention relates to devices that feed disc shaped tin tags to a nail gun, and in particular to devices which center and hold the tin tag under the hammer of the nail gun for safe and accurate center nailing of the tin tag to a host surface such as felt paper on a roof.

DISCUSSION OF THE RELATED ART

Tin tags are used extensively in the construction industry for securing materials to the roof or vertical walls of a building structure. Most notably, tin tags are used in the installation of a roof to securely fasten a felt paper in covering relation to the underlying plywood roof structure. To reduce fatigue and increase productivity and efficiency, most construction workers use a pneumatic nail gun for securing the overlay felt paper or other sheet materials to the roof structure and, where applicable, vertical walls of the building structure. The current practice is to place the tin tags on the felt paper, at the desired position, and then to move the hammer of the nail gun down against the tin tag, while applying downward pressure and pulling the trigger to fire the nail through the tin tag and into the underlying roof structure. Due to the relatively small size of tin tags in relation to the nail gun, it is difficult to center the tin tag directly below the hammer of the nail gun prior to firing the nail. Only the most skilled workers are able to position tin tags by hand with consistent accuracy and without injury. Present building codes in most jurisdictions require that the nail be driven through the center of the tin tag. Complying with these strict building code requirements presents significant problems to construction workers, and particularly roofers. Not only is it difficult to accurately position tin tags in centered alignment below the hammer of pneumatic nail guns, hand placement of tin tags presents a serious safety hazard to the operator of the pneumatic gun. In the effort to center the tin tag below the nail gun hammer on a sloped or vertical surface, the operator often positions his fingers to close to the hammer which, in some unfortunate instances results in a nail being fired through the gun operator's finger.

In an effort to overcome the problems associated with accurate and safe placement of tin tags for attachment with a pneumatic nail gun, others have proposed various devices for attachment to pneumatic nail guns which dispense tin tags below the hammer prior to firing the nail. Of particular relevance are the patents to McGuinness et al., U.S. Pat. Nos. 6,273,315; 5,791,546; and 5,634,583 and the U.S. patents to Zylka et al. U.S. Pat. Nos. 5,184,752 and 5,067,865. While the attachment devices in these patents are presumed to function to dispense and position tin tags below the firing hammer of pneumatic nail guns, they present significant shortcomings which limit the practicality of their use in the construction industry. In particular, the various attachment devices disclosed in the above-identified patents are cumbersome, complicated and relatively heavy, thereby significantly adding to the overall weight of the nail gun when attached thereto. Additionally, the relatively complex design, using a significant number of moving parts, renders these devices prone to jamming and/or failure. Furthermore, the attachment devices in the related art use vertical chambers for holding the tin tags in a stacked array. The lowermost tin tag in the stacked array is dispensed from the chamber for positioning under the hammer prior to firing the nail. This design is prone to jamming and sometimes results in more than one tin tag being dispensed, thereby resulting in two or more tin tags being nailed by a single nail fired from the gun. The present invention overcomes the problems and shortcomings of the related art and provides the structural features, functions and advantages as described hereinafter.

OBJECTS AND ADVANTAGES OF THE INVENTION

It is a principle object of the present invention to provide a gravity tin tag feeder for attachment to a nail gun to facilitate the centering of a nail that is fired from the gun and driven through the tin tag disc, to effectively and safely nail the tin tag to a host surface.

Another object of the present invention is to provide a gravity tin tag feeder for attachment to a nail gun that will hold a tin tag during the firing of a nail in order to reduce the risk of injury.

A further object of the present invention is to provide a gravity tin tag feeder for attachment to a nail gun that is of relatively simple construction and design with few moving parts and a high degree of reliability.

It is still a further object of the present invention to provide a gravity tin tag feeder for attachment to a nail gun that is of relatively low cost to produce.

It is yet another object of the present invention to provide a gravity tin tag feeder for attachment to a nail gun that is lightweight and will not add appreciable weight to the roofing nail gun.

A further object of the present invention is to provide an ambidextrous gravity tin tag feeder for attachment to a nail gun which is interconnected to the front center of the nail gun and allows left or right handed feeding of the tin tags to the nail gun.

Another object of the present invention is to provide a gravity tin tag feeder for attachment to a nail gun for use with staple firing guns.

SUMMARY OF THE INVENTION

The present invention is directed to a gravity tin tag feeder attachment that includes a solid frame with two attachment arms for attaching the tin tag feeder to an existing nail gun. The frame may be attached to the front center of the nail gun by any of a variety of means.

The top portion of the frame is open forward of the nail gun to allow individual deposit of tin tags into the feeder device by hand. The frame supports a chute which is defined primarily by a smooth sheet formed as a slide with a curved slope. The top portion of the chute is integral with or fixed to the frame. In a preferred embodiment, the bottom portion of the chute is constructed of flexible flat spring steel. Two guides may be attached on each side of the spring steel chute and a third elevated guide connects to the two guides. A hole (i.e. circular opening) slightly larger than the diameter of an average tin tag is located towards the end of the spring steel chute. One or more magnets are located directly to the rear of the hole at the end of the spring steel chute. The magnets are slightly elevated with spacers to allow the tin tag a space to rest under the magnet. The spacers also assist in centrally aligning the tin tag under the hammer. The hole is positioned in vertical axial alignment directly below the hammer of the nail gun. The diameter of the hole is sized to ensure that the tin tag will pass through and clear the hole, without obstruction, when the tin tag is nailed to the underlying host surface.

When a tin tag is dropped through the open top portion of the frame, the tin tag slides and accelerates by force of gravity, traveling flat down the chute. After the tin tag has cleared the fixed upper portion of the chute, it enters into the flexible lower portion of the chute. The two side guides ensure that the tin tag remains on path while the elevated guide ensures that the tin tag stays flat on the chute. The magnets attract the metal tin tag disc to line up over the opening. The combination of momentum achieved from the disc traveling down the chute and the two magnets ensure that the tin tag disc reaches the end of the chute and in axial alignment with the hammer, nail to fired from the hammer and the hole.

When the tin tag feeder is pressed against the host surface, the flexible spring steel bends upward, allowing the safety catch of the hammer of the nail gun to pass through the hole. Further pressing downward of the nail gun forces the safety catch to engage and allow the trigger of the nail gun to be operational. When the trigger of the nail gun is pressed, the pneumatic hammer of the nail gun sends a nail through the center of the tin tag, causing the tin tag to be pushed down and forced to release from the magnets. The tin tag then travels through the hole with the nail and is nailed to the host surface. Thereafter, the nail gun can be lifted and another tin tag can be dropped in the feeder.

The operator only needs to drop one tin tag disc at a time into the chute. The chute is at a safe distance from the hammer so the possibility of the operator nailing his or her hand is greatly diminished. After the tin tag is dropped into the chute, the gravity tin tag feeder attachment will hold the tin tag until the operator wills to nail the tin tag. This operation may be repeated quickly and continuously. The final result is a nail through the center of the tin tag, attaching the tin tag to the desired host surface.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
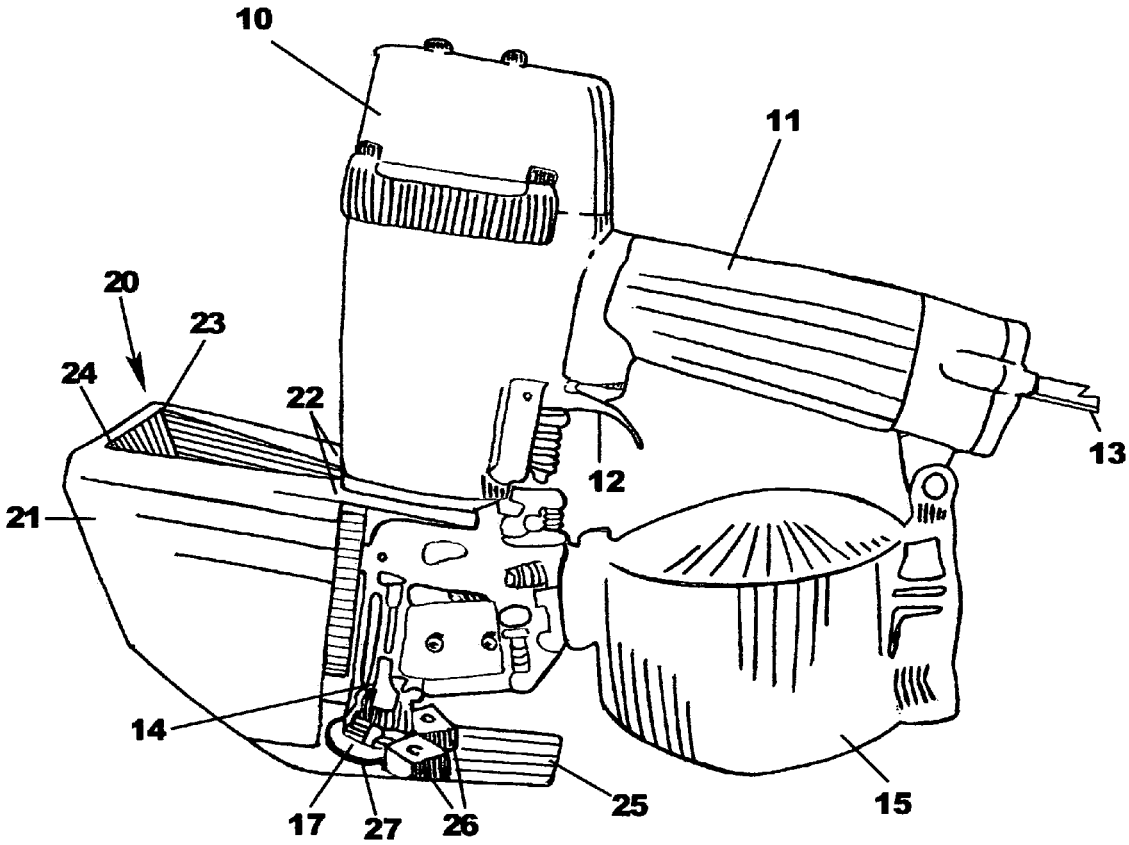
FIG. 1 is a side perspective view, showing the gravity tin tag feeder of the present invention attached to a nail gun.

In the description which follows, like parts are indicated throughout the specification and drawings with the same reference numerals, respectively. The drawings are not necessarily to scale and the proportions of certain parts have been exaggerated to better illustrate operation of the invention.

Figures 2, 3:
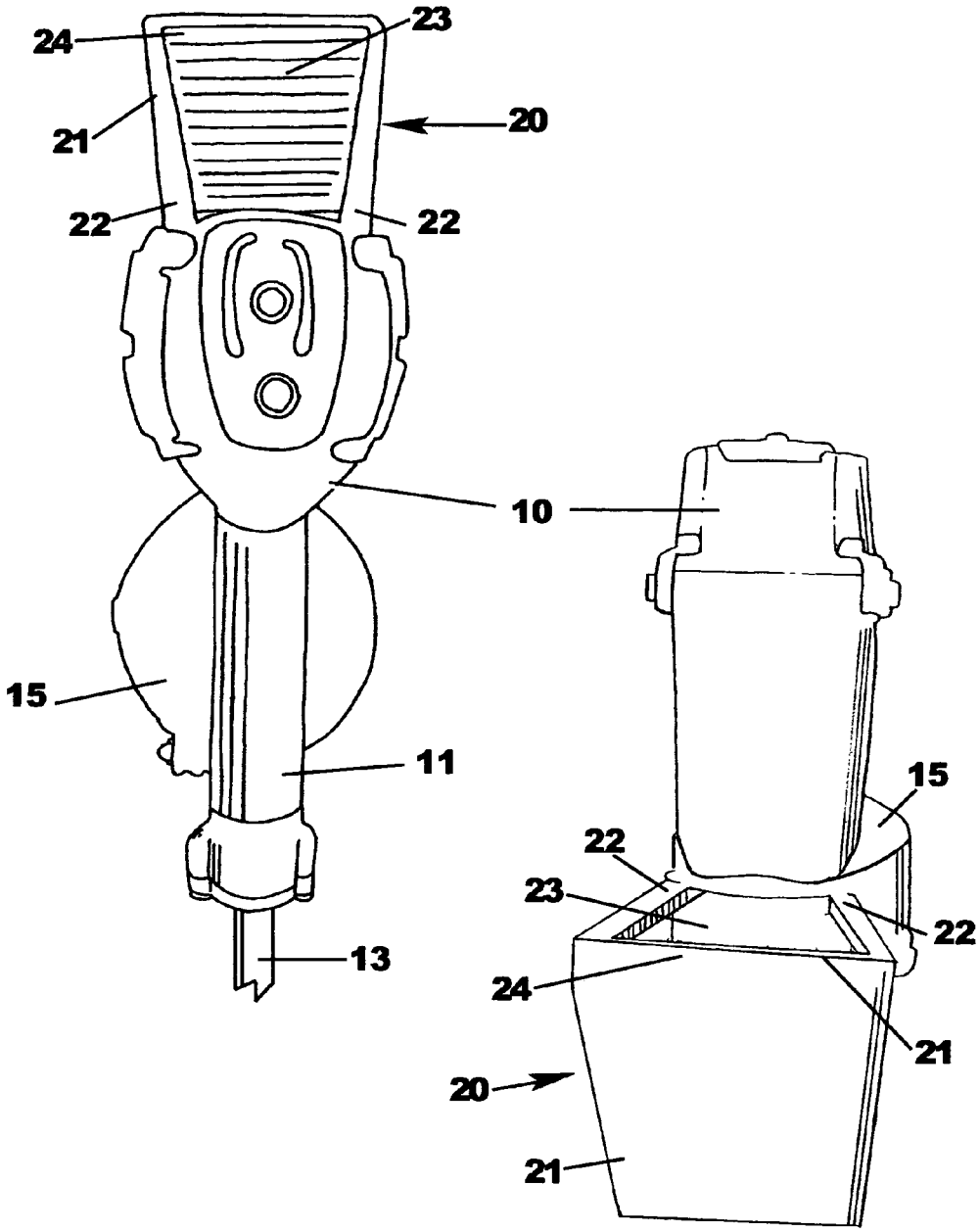
FIG. 2 is a top plan view of the nail gun and attached gravity tin tag feeder.
FIG. 3 is a front, top perspective view of the nail gun and attached gravity tin tag feeder.

In FIGS. 1, 2, and 3, nail gun 10 is a standard roofing nail gun with a handle 11, nail magazine 15, trigger 12, and pneumatic hammer 14. High pressure hose 13 connects to a high pressure source such as an air compressor or the like. Magazine 15 is loaded with nails 34.

Figure 4:
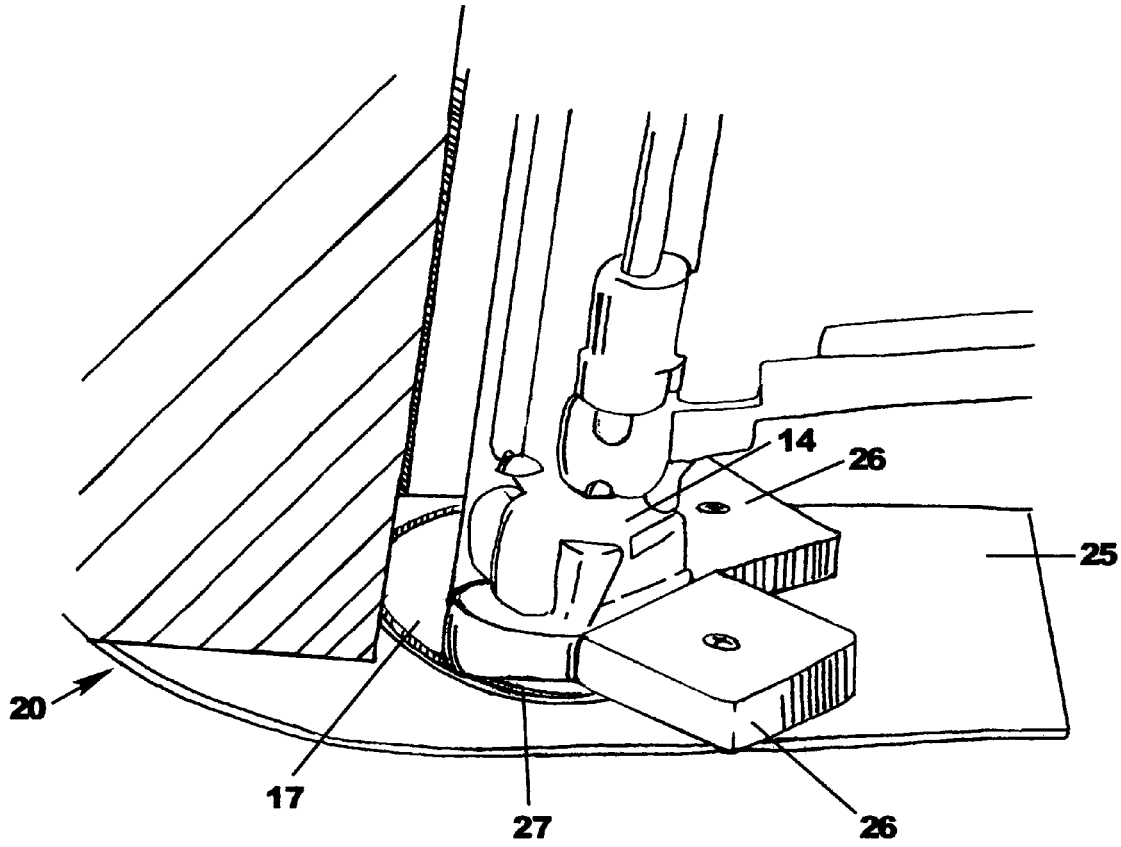
FIG. 4 is an isolated perspective view, showing the flat spring and magnet assembly with tin tag disc aligned under the nail gun hammer.

The tin tag feeder device 20 is shown attached to the nail gun 10 throughout the several views of the drawings. A frame structure 21 of the gravity tin tag feeder device 10 has arms 22 which attach to an underside of the main housing of the nail gun with the use bolts, screws or other suitable hardware fasteners 16. The frame structure 21 is formed to be open at the top, between the arms 22, to define a deposit opening 23 which communicates with a slide chute 24. In a preferred embodiment, the chute 24 includes a lower portion 25 formed of a flexible flat spring sheet material. As seen in FIGS. 1 and 4, two magnets 26 are fastened to the top side of the flat spring lower portion 25. The magnets are specifically positioned to magnetically engage a tin tag disc 17 which slides down chute 24 and to hold the tin tag disc 17 in centered alignment below hammer 14 and above a passage hole 27 formed through the flat spring lower portion 25. The diameter of passage hole 27 is slightly larger than the diameter of the tin tag disc 17, thereby enabling subsequent passage of the tin tag disc 17 therethrough upon operation of the nail gun to secure the tin tag disc 17 to an underlying host surface 32 as described more fully hereinafter.

Figure 5:
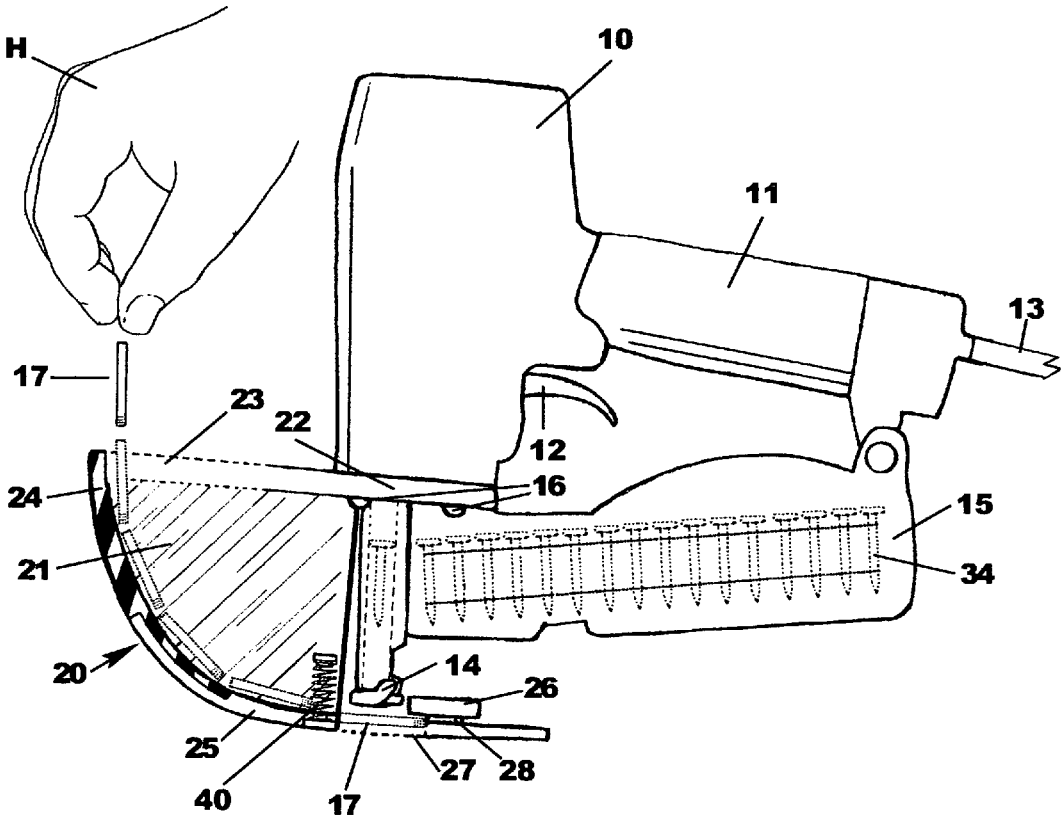
FIG. 5 is a side elevational view, in partial section, showing a hand dropping a tin tag into the gravity tin tag feeder while attached to a nail gun.

As seen in FIG. 5, the operator's hand H manually drops tin tag 17 through the deposit opening 23 and onto slide chute 24. The force of gravity causes the tin tag 17 to slide down and accelerate along chute 24 and across the top of the flat spring lower portion 25. Spacer 28 below each of the magnets 26 is positioned to stop the tin tag 17. Spacer 28 is relatively equal to the height of tin tag 17 and assists in centering the tin tag 17 over the hole 27 and directly below the hammer 14, while magnets 26 prevent the tin tag from falling through the hole. Specifically, tin tag 17 is held under the edge of magnets 16 by magnetic attraction. The tin tag passage hole 27 has a slightly larger diameter than the tin tag 17, permitting passage of the tin tag therethrough, without obstruction, when the nail is fired from the gun and driven through the tin tag. When the feeder device 20 is properly secured to the nail gun 10, the passage hole 27 is positioned in centered, axial alignment below the hammer 14.

Figure 6:
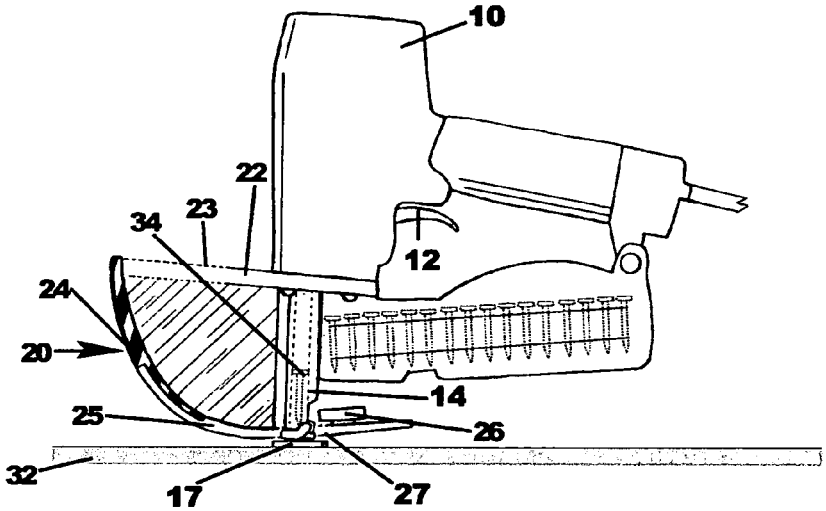
FIG. 6 is a side elevational view, in partial section, showing the gravity tin tag feeder attached to a nail gun while pressing a tin tag disc against the host surface.
Figure 7:
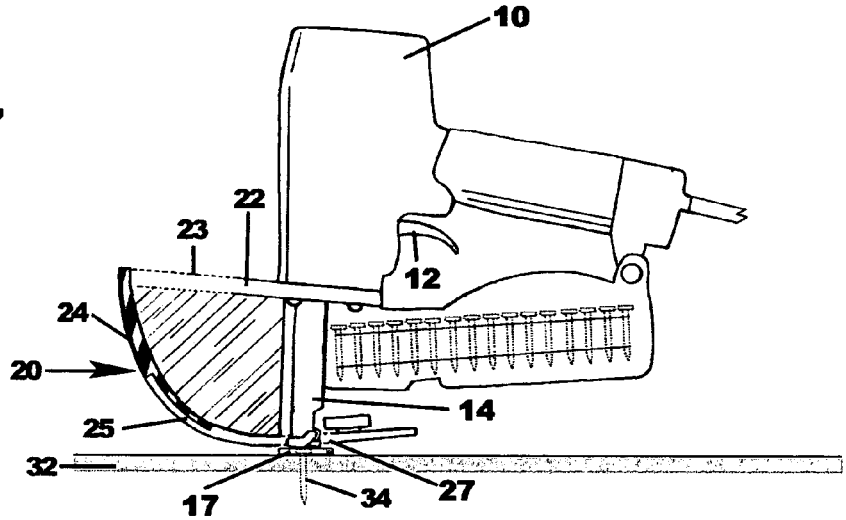
FIG. 7 is a side elevational view, in partial section, showing the gravity tin tag feeder attached to a nail gun while driving a nail through the tin tag to the host surface.
Figure 8:
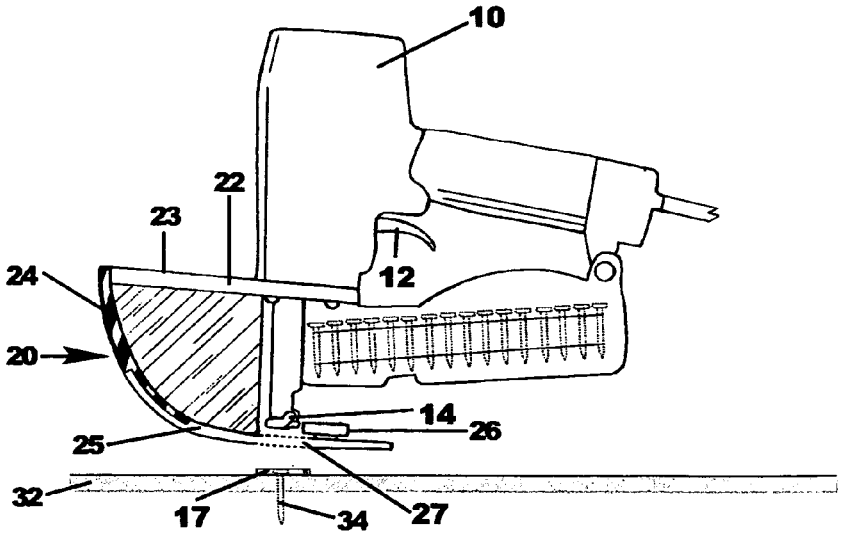
FIG. 8 is a side elevational view, in partial section, showing the gravity tin tag feeder attached to a nail gun moving away from the host surface after the tin tag has been nailed to the host surface.

As shown in FIG. 6, manually pressing down against a host surface 32 will cause flat spring lower portion 25 to bend upward. This allows the hammer 14 to be moved downward towards the underlying tin tag 17 and host surface 32. Eventually, the tin tag 17 becomes sandwiched between the host surface 32 and hammer 14. The magnetic attraction is broken as the hammer 14 presses down on the top of the tin tag 17 and magnets 16 move up and away from tin tag 17. At this point, the tin tag 17 has passed within or through passage hole 27 and is held flat to the host surface. When trigger 12 is pressed (see FIG. 7), nail 34 is driven through the center of tin tag 17. When the nail gun 10 is lifted, as seen in FIG. 8, tin tag 17 remains nailed to the host surface 32.

In a further embodiment, at least one spring 40 is attached between the flat spring lower portion 25 and the frame structure 21 to promote flexing movement of the flat spring lower chute portion 25, allowing the flat spring lower portion 25 to move upwardly when the nail gun is forced down towards the host surface, and further allowing the flat spring lower portion 25 to return to the relaxed position, as seen in FIG. 5, when the nail gun is lifted from the host surface. It should be noted that the one or more springs 40 may be used in conjunction with the flexible flat spring sheet material of the lower portion 25 or, as an alternative biasing element in substitution for the flexible flat spring sheet material.

While the present invention has been shown and described in accordance with preferred and practical embodiments thereof, it is recognized that departures from the instant disclosure are contemplated within the spirit and scope of the present invention which should not be limited except as defined in the following claims as interpreted under the doctrine of equivalents.

What is claimed is:

1. A nail gun attachment device for individually feeding and positioning tin tags relative to a hammer of a nail gun prior to firing a nail from the hammer to secure the tin tag to an underlying host surface; the nail gun attachment device comprising:

a plate member movable relative to the hammer of the nail gun in response to an upward force upon urging the plate against the underlying host surface and while forcing the nail gun downwardly towards the host surface including a passage hole formed through the plate in axial alignment below the hammer, wherein the plate is movable relative to the hammer of the nail gun, the passage hole being sized and configured to permit passage of the tin tag disc therethrough with the plane of the tin tag disc perpendicular to the vertical axis of the hammer and the passage hole;

wherein the plate member is firmly secured to the nail gun; and at least two magnetic points for holding the tin tag by magnetic attraction in centered axial alignment so that the nail fired from the nail gun is driven through the center of the tin tag, wherein the magnetic points are positioned to the rear of the passage hole and spaced sufficiently apart as to provide equal and sufficient magnetic attraction in order to pull and line up the tin tag in vertical axial alignment directly below the hammer of the nail gun;

wherein the magnetic points make contact with the top portion of the tin tag disc thereby holding the tin tag disc over the passage hole by magnetic attraction; and a spacer is sandwiched between each magnet point and the top surface of the plate, the spacers defining a stopper for stopping sliding passage of the tin tag along the top surface of the plate and for positioning the tin tag in centered axial alignment for holding by the magnetic points.

2. A nail gun attachment device for individually feeding and positioning tin tags relative to a hammer of a nail gun prior to firing a nail from the hammer to secure the tin tag disc to an underlying host surface; the nail gun attachment device comprising:

a frame arrangement structured and disposed to firmly secure the device to the nail gun including;

a slide chute comprising:

an upper section;

a lower section;

a deposit opening for manually depositing the tin tag into the device and is situated in the top portion of the upper section of the slide chute; and a plate movable relative to the hammer of the nail gun in response to an external upward force applied to the plate, and the plate having a passage hole formed through the plate, the passage hole being sized and configured to permit passage of the tin tag disc therethrough with the plane of the tin tag disc perpendicular to the vertical axis of the hammer and the passage hole; and at least two magnetic points for directing and holding the tin tag disc in centered axial alignment relative to the hammer and passage hole so that when the nail gun is operated to fire the nail, the tin tag is moved through the passage hole and against the host surface and the nail is driven through the tin tag disc and into the host surface to thereby secure the tin tag to the host surface, wherein the magnetic points are positioned to the rear of the passage hole and spaced sufficiently apart as to provide equal and sufficient magnetic attraction in order to pull and line up the tin tag in vertical axial alignment directly below the hammer of the nail gun;

wherein the magnetic points make contact with the top portion of the of the tin tag disc thereby holding the tin tag disc over the passage hole by magnetic attraction; and a spacer is sandwiched between each magnet point and the top surface of the plate, the spacers defining a stopper for stopping sliding passage of the tin tag along the top surface of the plate and for positioning the tin tag in centered axial alignment for holding by the magnetic points; and wherein an operator may drop a tin tag under constant gravitational force into the deposit opening thereby accelerating the tin tag down the slide chute which is structured and disposed to deliver the tin tag to the spacers and to the magnetic points to hold and position the tin tag under magnetic attraction and in centered axial alignment relative to the vertical axis of the hammer and said passage hole.

3. The nail gun attachment device as recited in claim 2 wherein the plate is formed of a flexible spring sheet material.

4. The nail gun attachment device as recited in claim 3 wherein the flexible spring sheet material is spring steel.

5. The nail gun attachment device as recited in claim 2 further comprising:

a biasing element for permitting yielding movement of the plate relative to the hammer in response to the external upward force and for returning the plate to a relaxed position below the hammer upon removal of the external upward force.

6. The nail gun attachment device as recited in claim 5 wherein the biasing element comprises:

at least one spring attached to the plate and the frame arrangement of the device.

7. The nail gun attachment device as recited in claim 2 wherein each magnet point is constructed of a separate and individual magnet.

8. The nail gun attachment device as recited in claim 2 wherein the magnetic points are formed in the shape of one individual curved shaped magnet.

9. A nail gun attachment device for individually feeding and positioning tin tags relative to a hammer of a nail gun prior to firing a nail from the hammer to secure the tin tag to an underlying host surface; said nail gun attachment device comprising:

a frame structure including:

a deposit opening for manually depositing the tin tag into the device;

a first arm;

a second arm;

a first side wall in a substantial vertical alignment with the first arm and positioned below the first arm;

a second side wall in substantial vertical alignment with the second arm and positioned below the second arm;

wherein the deposit opening is situated horizontally between the first arm and the second arm, and wherein each arm is structured and disposed to firmly secure the device to the nail gun; and a slide chute positioned in between the first side wall and the second side wall comprising:

an upper section;

a lower section; and a plate member situated in the lower section of the slide chute movable relative to the hammer of the nail gun in response to an upward force upon urging the plate against the underlying host surface and while forcing the nail gun downwardly towards the host surface including a smooth top surface for sliding passage of the tin tag disc there along a passage hole formed through the plate in axial alignment below the hammer, wherein the plate is movable relative to the hammer of the nail gun, the passage hole being sized and configured to permit passage of the tin tag disc therethrough with the plane of the tin tag perpendicular to the vertical axis of the hammer and the passage hole, wherein the plate is formed of a flexible spring sheet material; and at least two magnetic points for holding the tin tag by magnetic attraction in centered axial alignment so that the nail fired from the nail gun is driven through the center of the tin tag, wherein the magnetic points are positioned to the rear of the passage hole and spaced sufficiently apart as to provide equal and sufficient magnetic attraction in order to pull, hold, and line up the tin tag in vertical axial alignment directly below the hammer of the nail gun;

wherein the magnetic points make contact with the top the of the tin tag disc thereby holding the tin tag disc over the passage hole by magnetic attraction; and a spacer is sandwiched between each magnet point and the top surface of the plate, the spacers defining a stopper for stopping sliding passage of the tin tag disc along the top surface of the plate and for positioning the tin tag in centered axial alignment for holding by the magnetic points; and wherein an operator may drop a tin tag under constant gravitational force into the deposit opening thereby accelerating the tin tag down the slide chute which is structured and disposed to deliver the tin tag to the spacers and to the magnetic points to hold and position the tin tag under magnetic attraction and in centered axial alignment relative to the vertical axis of the hammer and the passage hole.

10. The nail gun attachment device as recited in claim 9 wherein said flexible spring sheet material is spring steel.

11. The nail gun attachment device as recited in claim 9 further comprising:

a biasing element for permitting yielding movement of the plate relative to the hammer in response to the upward force and for returning the plate to a relaxed position below said hammer upon removal of the upward force.

12. The nail gun attachment device as recited in claim 11 wherein the biasing element comprises:

at least one spring attached to the plate and the frame structure of the device.

13. The nail gun attachment device as recited in claim 9 wherein each magnet point is constructed of a separate and individual magnet.

14. The nail gun attachment device as recited in claim 9 wherein the magnetic points are formed in the shape of one individual curved shaped magnet.

* * * * *